US009850112B2

(12) United States Patent
Lawson et al.

(10) Patent No.: US 9,850,112 B2
(45) Date of Patent: Dec. 26, 2017

(54) LOAD BEARING APPARATUS AND METHOD

(71) Applicant: Parkburn Precision Handling Systems Limited, Hamilton (GB)

(72) Inventors: Andrew Lawson, Hamilton (GB); Campbell McFall, Hamilton (GB); Dennis O'Hara, Hamilton (GB); Philip Bull, Cheswardine (GB)

(73) Assignee: Parkburn Precision Handling Systems Limited (GB)

( * ) Notice: Subject to any disclaimer, the term of this patent is extended or adjusted under 35 U.S.C. 154(b) by 0 days.

(21) Appl. No.: 14/782,904

(22) PCT Filed: Apr. 16, 2014

(86) PCT No.: PCT/GB2014/051190
§ 371 (c)(1),
(2) Date: Oct. 7, 2015

(87) PCT Pub. No.: WO2014/170671
PCT Pub. Date: Oct. 23, 2014

(65) Prior Publication Data

US 2016/0031685 A1 Feb. 4, 2016

(30) Foreign Application Priority Data

Apr. 17, 2013 (GB) ..... 1306974.5

(51) Int. Cl.
*B66D 1/74* (2006.01)
*B66D 1/30* (2006.01)
(Continued)

(52) U.S. Cl.
CPC ..... *B66D 1/7442* (2013.01); *B66D 1/30* (2013.01); *B66D 1/50* (2013.01); *B66D 1/505* (2013.01);
(Continued)

(58) Field of Classification Search
CPC ..... B66B 11/0075; B66B 11/06; B66D 1/74; B66D 1/7405; B66D 1/26; B66D 1/36; B66D 1/50
See application file for complete search history.

(56) References Cited

U.S. PATENT DOCUMENTS 605,937 A 6/1898 Turner
3,261,591 A * 7/1966 Campbell ..... B63B 21/16 254/295
(Continued)

FOREIGN PATENT DOCUMENTS

CN 201220899 4/2009
DE 19525921 11/1996
(Continued)

OTHER PUBLICATIONS

International Search Report to corresponding Int'l Pat. Appl. No. PCT/GB2014/051190, dated Oct. 7, 2014, 5 pages.

*Primary Examiner* — William A Rivera
*Assistant Examiner* — Stefan Kruer
(74) *Attorney, Agent, or Firm* — Tarolli, Sundheim, Covell & Tummino LLP

(57) ABSTRACT

A load-bearing apparatus (100) comprises a winch apparatus (110), and a load-bearing spoolable medium (120) for connecting to a load, the load-bearing spoolable medium comprising a plurality of load-bearing elements (121-123); wherein at least a portion of the load-bearing spoolable medium is spooled about the winch apparatus. The provision of multiple load-bearing elements may help reduce the diameter appropriate for the winch apparatus, while maintaining the necessary load bearing capacity for supporting, paying in and/or paying out the load. The load-bearing apparatus may comprise a tension control apparatus (151-
(Continued)

153) for controlling, applying and/or adjusting the tension of the load-bearing spoolable medium.

31 Claims, 4 Drawing Sheets

(51) Int. Cl.

| | |
|---|---|
| ***B66D 1/50*** | (2006.01) |
| ***B66B 11/06*** | (2006.01) |
| *B66D 1/76* | (2006.01) |
| *B66B 5/00* | (2006.01) |
| *B66B 1/24* | (2006.01) |
| *B66B 11/00* | (2006.01) |

(52) U.S. Cl.
CPC ..... *B66D 1/741* (2013.01); *B66D 1/7463* (2013.01); *B66B 1/24* (2013.01); *B66B 5/0006* (2013.01); *B66B 11/0075* (2013.01); *B66B 11/06* (2013.01)

(56) References Cited

U.S. PATENT DOCUMENTS

| | | | | |
|---|---|---|---|---|
| 3,533,358 | A * | 10/1970 | Leuenberger | B63B 27/18 104/114 |
| 3,825,197 | A * | 7/1974 | Sturgeon | B65H 54/2812 242/419.5 |
| 3,971,545 | A * | 7/1976 | Warman | B66D 1/20 254/273 |
| 4,309,023 | A * | 1/1982 | Plumettaz | B66D 1/54 182/36 |
| 4,600,086 | A | 7/1986 | Yamasaki et al. | |
| 5,221,059 | A * | 6/1993 | Coons, III | D02J 1/22 242/147 R |
| 6,042,087 | A | 3/2000 | Heinemann | |
| 6,182,915 | B1 | 2/2001 | Kvalsund et al. | |
| 2004/0026056 | A1* | 2/2004 | Schweiger | B65H 23/1886 162/198 |
| 2005/0224295 | A1* | 10/2005 | Shimizu | F21V 21/38 187/250 |
| 2006/0022182 | A1* | 2/2006 | Blanc | B66D 1/7405 254/293 |
| 2007/0107867 | A1* | 5/2007 | Schmachtel | D21G 9/0009 162/198 |
| 2007/0290182 | A1* | 12/2007 | Noeske | B66C 13/18 254/327 |
| 2010/0262384 | A1* | 10/2010 | Marfani | B65H 59/40 702/43 |

FOREIGN PATENT DOCUMENTS

| | | |
|---|---|---|
| EP | 0699618 | 5/1995 |
| EP | 1460025 | 3/2004 |
| GB | 2155904 | 10/1985 |
| JP | 7196288 | 8/1995 |
| JP | 1111882 | 1/1999 |
| RU | 412133 | 2/1974 |
| RU | 724433 | 3/1980 |
| WO | 2011121272 | 10/2011 |

* cited by examiner

LOAD BEARING APPARATUS AND METHOD

FIELD OF THE INVENTION

The present invention relates to a load-bearing apparatus comprising multiple load-bearing elements, to a traction device for use in such, and to a tension control apparatus for controlling the tension of each of the load-bearing elements.

BACKGROUND TO THE INVENTION

Numerous fields of application require the deployment of heavy loads to/from a location of interest, including building, construction, mining, oil and gas, etc. One such application involves the deployment of sub-sea hardware in very deep water, e.g., at depths of 1000 m and greater. Deep water deployment of sub-sea hardware is particularly associated with the oil and gas industry. Examples of such sub-sea hardware include manifolds, templates, processing modules and wellhead systems. Assemblies of this type can weigh hundreds of tonnes. Similarly, extreme loads may be encountered when lifting or lowering a pipeline or section of pipeline to or from the seabed during installation and/or maintenance.

Deep water deployment systems including cranes employ a variety of mechanisms and typically include traction systems to move payloads via load-bearing spoolable media, such as metal, synthetic or natural fibre cables, wires and ropes. Traction systems include a drum winch around which a spoolable medium is wound, wherein rotation of the drum permits spooling of the medium.

In some species of winch the drum acts to store the spoolable medium, with the medium be arranged in single or multiple wraps and layers between end flanges of the drum. In such winch species, however, the spoolable medium may be subject to significant radial crushing forces, particularly in circumstances where large payloads are involved and thus significant tensions are applied to the spoolable medium. Further, in some applications it may be necessary to store the medium in a high tension state, which may reduce the life span of the medium through fatigue, excessive strains, hysteresis and the like. Furthermore, storage of the spoolable medium on a drum typically requires the use of complex fleeting arrangements to ensure that the medium is arranged in suitable wraps and layers.

In other species of winch the drum is used only to apply a force to a spoolable medium, with the spoolable medium being stored separately, for example in a basket, on a separate spool or the like. The force applied by the drum is typically either a pulling force to pay in a spoolable medium, or a controlled releasing force to permit controlled paying out of a spoolable medium while under load, for example while connected to a payload. In such winch species, which may include capstan or windlass winches, an intermediate portion of a spoolable medium is wrapped around the drum a number of times such that an outboard side of the spoolable medium extends from the drum to engage a payload, and an inboard side of the spoolable medium extends to storage. Under loaded conditions the drum functions to reduce the tension in the spoolable medium from a high tension condition in the outboard side, to a lower tension condition in the inboard side of the spoolable medium, thus permitting the spoolable medium to be stored in a favourable low tension state. In view of this tension reduction functionality, such winch species are often called detensioning units. In use, the drum establishes a tension gradient in the spoolable medium, which may be defined by the capstan friction equation:

$$\frac{T_1}{T_2} = e^{\mu\theta}$$

wherein:

$T_1$=outboard tension $T_2$=inboard tension $\mu$=co-efficient of friction between the spoolable medium and the drum or contact surface $\theta$=angle of contact with the drum (e.g., one wrap is $2\pi$ radians)

The traction winch may include multiple sheaves over which the rope is drawn both to provide adequate traction and to progressively unload the rope before it is passed to the storage take up reel at low tension. An example of such traction winch is disclosed in U.S. Pat. No. 6,182,915 (ODIM HOLDING ASA), which is incorporated herein by reference, in which the multiple sheaves are separately powered in a manner to prevent the cable from being damaged by slipping as it unloads. Another example is disclosed in International Patent Application Publication No. WO 2011/121272 (PARKBURN PRECISION HANDLING SYSTEMS LTD), which is incorporated herein by reference, in which two traction winch drums configured to rotate about respective first and second axes of rotation which are inclined relative to each other. The relative inclined alignment of the first and second axes of rotation of the drum assemblies permits the respective drum contact surfaces to cooperate to manipulate an associated spoolable medium to follow a predefined path, such as a predefined helical path.

When steel is used as a spoolable medium, the deployment of very large loads of the type described above requires the use of very large steel wire ropes or cables. However, especially at great depths, the weight of the steel itself becomes a significant problem. Not only does this impose tremendous loads on the lifting system but also, beyond a certain depth, it becomes impossible to make a wire rope large enough to support its own weight without exceeding its safe working loads, let alone the weight of the equipment to which it is attached.

In order to reduce the weight of the spoolable media used in very deep water applications, synthetic fibre ropes have been adopted. Synthetic fibre ropes typically exhibit near neutral buoyancy and therefore minimal added weight, even when working at great depths. Such ropes can be made from a variety of synthetic fibres. Ultra High Molecular Weight Polyethylene (UHMWPE) fibre rope has proven especially successful due to its high strength to weight ratio and low elongation under loads. For example, suitable UHMWPE fibre ropes are available under the Dyneema® trademark of DSM, The Netherlands.

Although synthetic fibre ropes offer a viable solution for deep water deployment, and are vastly superior to steel wire rope in many respects, they nevertheless present special challenges of their own, especially when used in larger diameters. In particular, when used with traction winches, synthetic fibre ropes typically require larger diameter sheave wheels than do wire ropes. A number of reasons for this may include (among others) the susceptibility of individual fibres to fracture when bent and also the relative inability of the fibre material to shed heat due to its low thermal conductivity, which can in turn lead to heat build-up and damage to the fibres in the core of the rope. As a result, it has been determined that the practical minimum "D:d" diameter ratio for using large synthetic fibre ropes on traction winch systems is approximately 30:1, wherein "D:d" represents the ratio between the diameter of the sheave wheel and the diameter of the rope. Current research focusing on loads of 250Te indicates that a synthetic fibre rope having the requisite capacity (including industry established safety margins) will have a diameter on the order of 140 mm. Based on the minimum 30:1 ratio, the corresponding minimum sheave diameter is approximately 4.2 m, which is very large. A 750Te system would require a proportionately larger rope, to the point where the sheave wheels and associated machinery would be prohibitively large. Not only is the cost of such equipment very high, but it is compounded by the need to use a larger vessel and a larger crew, to the point where feasibility is drawn into question.

Furthermore, very large diameter synthetic ropes present additional problems. In particular, ropes do not scale well and suffer a loss of strength translation efficiency in their larger sizes. Furthermore, it has been found that, even when using optimally-sized sheaves, the larger the rope the lower the number of bend cycles it is able to sustain before failure. Although the reasons for this are not entirely clear, and without wishing to be bound by theory, it is believed that this may be primarily due to the mass of material involved and the impact of the heat and abrasion generated by the greater number of crossover points within the rope structure, complicated by the insulation efficiency of the fibre material. Yet another difficulty is that splices or other repairs in large-size synthetic ropes increase diameter, which makes it very difficult for these to pass through the grooves of conventional sheave wheels, particularly on the leading sheave wheel where the rope is under extreme tension.

Systems using multi fall arrangements have been used in the past to seek to overcome some of the limitations cited above, and have been used with both steel wire and fibre rope systems. However, although this technique overcomes the need for large diameter ropes, some limitations of this approach include reduction of deployment speed by a factor proportionate to the number of falls in the moving block. This creates a significant increase in deployment time and hence results in a high cost impact when deploying payloads in great water depths. This also creates difficulty achieving sufficient speed in the lifting line when employing active heave compensation required for decoupling the vessel motions from the payload during deployment.

Systems using multiple separate drum winch systems with single lift lines connected to the payload have been used with some success to overcome these issues. However, the challenge of controlling multiple systems and balancing high tension loads in each of the lifting wires is a significant challenge, and the risks involved if precise control is not maintained between the separate winch systems make this technique difficult to implement.

Various arrangements of multiple ropes or cables combined with one or more drums are disclosed in EP 1 460 025 (Strödter), U.S. Pat. No. 605,937 (Turner), U.S. Pat. No. 6,042,087 (Heinemann), U.S. Pat. No. 4,600,086 (Yamasaki et al.), JP 11-011882 (Mitsubishi), JP 07-196288 (Japan Steel Works), SU 412133 (Leningrad Lengidrostal), and CN 201220899 Weihua Group).

SUMMARY OF THE INVENTION

According to a first aspect of the present invention there is provided a load-bearing apparatus comprising:

a winch apparatus; and a load-bearing spoolable medium for connecting to a load, the load-bearing spoolable medium comprising a plurality of load-bearing elements;

wherein at least a portion of the load-bearing spoolable medium is spooled about the winch apparatus.

The winch apparatus may comprise a contact surface for engaging at least a portion of the load-bearing medium, e.g. at least a portion of the plurality of load-bearing elements, e.g. at least a portion of each of the plurality of load-bearing elements.

The winch apparatus may be configured to control paying out and/or paying in of the plurality of load-bearing elements. The winch apparatus may be configured to control paying out and/or paying in of each of the plurality of load-bearing elements simultaneously.

The winch apparatus may be configured to function as a detensioning device for use in reducing tension within the load-bearing medium. As such, the winch apparatus may comprise or define a detensioning device.

The winch apparatus may be configured as a capstan winch.

The load-bearing spoolable medium may comprise an outboard or high tension portion, between the load and the winch apparatus.

The load-bearing spoolable medium may comprise an inboard or low tension portion, on a side of the winch apparatus opposite the load.

The winch apparatus may comprise an outboard or high tension side, between the load and the winch apparatus.

The winch apparatus may comprise an inboard or low tension side, on a side of the winch apparatus opposite the load.

One or more load-bearing elements may comprise an elongate element, such as a rope, cable, wire, or the like.

One or more load-bearing elements may comprise a multicomponent element, such as a rope, cable, wire, or the like.

One or more load-bearing elements may comprise a synthetic fibre rope, a metal rope such as a steel rope, or the like.

The cross-section of one or more load-bearing elements may be substantially circular, oval, rectangular (e.g. a so-called "flat rope), or may have any other suitable profile.

One or more load-bearing elements may be made from a polymeric material, for example UHMWPE such as sold under the trade names of DYNEEMA® and SPECTRA®; a liquid crystal polyester (LCP) such as sold under the trade name of VECTRAN®; an aramid such as sold under the trade name TECHNORA®, or blends thereof. By such provision, the load-bearing elements may exhibit suitable characteristics for heavy lift applications, including robustness, very high strength to weight ratios, good bend fatigue and tension-tension fatigue, low levels of elongation vs load, appropriate levels of base material friction, and ready availability.

Load elongation of the plurality of load-bearing elements may typically be in the range of 0-4%, wherein 0% may correspond to a load elongation at very low loads, and 4% may correspond to a load elongation at break load. Typical load elongation between low loads and maximum working load may be in the region of 0-1.5%.

Each of the plurality of load-bearing elements may be made substantially from the same material, may be of a similar physical construction, and/or may be provided with similar coating(s). By such provision, the plurality of load-bearing elements may behave in similar fashion, e.g. on the contact surface of the winch apparatus. For example, the load-bearing elements may exhibit similar coefficients of friction, heat transfer properties, abrasion resistance, flexibility, or the like.

The construction of one or more of the plurality of load-bearing elements, e.g. ropes, may comprise a braided construction, e.g. a balanced braid, such as an 8-strand or 12-strand braided rope structure and/or variations thereof. Such constructions may be advantageous in the apparatus of the present invention as they are torque neutral over a wide load range, can be easily spliced and repaired, and can be made in very long lengths.

The construction of one or more of the plurality of load-bearing elements, e.g. ropes, may comprise wire lay constructions. In such instance, the plurality of load-bearing elements may comprise an even number of elements/ropes with equal and opposite left and right hand lay constructions. This may assist in avoiding or reducing any impact form torque mismatch between the individual elements/ropes.

The plurality of load-bearing elements may comprise 2-10 load-bearing elements, typically 2-5 load-bearing elements. In one embodiment the plurality of load-bearing elements may comprise 3 load-bearing elements. The provision of 2-10, e.g. 2-5, e.g. three load-bearing elements, may significantly reduce the diameter appropriate for the winch apparatus, while maintaining the number of load-bearing elements relatively low to minimise difficulty of handling or risks of malfunction associated with a multiple rope system.

The load-bearing medium may comprise a plurality of separate and/or distinct load-bearing elements. It will be understood that the terms "separate and distinct" are not meant to limit the configuration of the load-bearing elements relative to each other, i.e. the load-bearing elements may be in contact, or may not be in contact, with each other. Thus, the terms "separate and distinct" are meant to indicate that the load-bearing elements each support, e.g. independently, a proportion, e.g. a predetermined amount or proportion of the weight of the load. By such provision, a dimension, e.g. a diameter, of each of the load-bearing elements may be reduced compared to a dimension, e.g. diameter, of a corresponding single load-bearing medium that would be required to support the same load. One of the effects and advantages of such reduction in diameter of the load-bearing elements is that the diameter of a winch used with such load-bearing elements may be reduced. Winch systems typically have an optimum diameter based on the diameter of the spoolable medium used. Therefore, reduction in the diameter of the load-bearing elements may allow significant reduction in the diameter of the winch apparatus, e.g. a drum thereof.

The load-bearing spoolable medium may comprises a plurality of adjacent load-bearing elements.

The load-bearing elements may be arranged side-by-side on the winch apparatus, e.g. on a contact surface of the winch apparatus.

The load-bearing elements may be arranged in a common plane.

The load-bearing elements may be arranged on the winch apparatus in a plane being generally in a direction of, or parallel to, an axis, e.g. to a rotational axis, of the winch apparatus.

The load-bearing elements, e.g. the adjacent and/or side-by-side load-bearing elements, may be substantially parallel to each other, e.g. when in engagement with the contact surface of the winch apparatus. The load-bearing elements may be substantially parallel to each other when in engagement with the contact surface of the winch apparatus, in a plane substantially parallel to an axis, e.g. to an axis of rotation, of the winch apparatus, and/or tangential to a surface of the winch apparatus.

The load-bearing elements, e.g. an outboard portion thereof, may be substantially parallel to each other.

The load bearing spoolable medium may define one or more turns around the winch apparatus.

Typically, the load bearing spoolable medium may define a plurality of turns around the winch apparatus.

The load-bearing elements may be provided in sequential order around or about the winch apparatus. A turn of a load-bearing element may be separated from an adjacent turn of the same load-bearing element, by the remaining load-bearing elements. Each turn of the load bearing spoolable medium may comprise a turn of the load-bearing elements provided in sequential order on the winch apparatus.

The weight of the load may be distributed amongst the plurality of load-bearing elements.

In one embodiment, the weight of the load may be substantially evenly distributed amongst the plurality of load-bearing elements.

In another embodiment, the weight of the load may be unevenly distributed amongst the plurality of load-bearing elements. For example, one or more load-bearing elements may be selected to bear a higher or lower load compared to the other load-bearing elements, e.g. temporarily, in order to accommodate, for example, operational or environmental requirements, fatigue or wear of one or more load-bearing elements, etc.

A dimension, e.g. a diameter, of two or more load-bearing elements, may be substantially identical.

Two or more of the plurality of load-bearing elements may have a different dimension, e.g. diameter, from a dimension, e.g. diameter, of at least another one or more of the plurality of load-bearing elements.

The term "diameter" used herein is not meant to limit the profile of the load-bearing elements to a particular profile, such as circular in cross-section, but is meant to refer to a general height and/or width of a cross-section of the load-bearing elements.

The load may comprise a single load. In such instance each of the plurality of load-bearing elements may be configured for supporting, connecting to and/or attaching to a single load. By such provision, a dimension, e.g. a diameter, of each of the load-bearing elements may be reduced compared to a dimension, e.g. diameter, of a corresponding single load-bearing medium that would be required to support the same load. This may allow significant reduction in the diameter of a winch apparatus, a drum thereof, to be used with such load-bearing elements.

The at least one load may comprise a plurality of loads. In one embodiment, each of the plurality of load-bearing elements may be configured for supporting, connecting to and/or attaching to a respectively load. By such provision, the load-bearing apparatus may allow deployment and/or handling of multiple loads using a single winch apparatus. This may be particularly advantageous, e.g. when a plurality of similarly weighed objects required to be lowered/hoisted/supported to/from/at a given location, for example sections of tubing or casing, manifolds, etc.

Various combinations of the above may be envisaged. For example, one of the plurality of load-bearing elements may be connected to a load of relatively low weight, while several of the plurality of load-bearing elements may be connected to a load of relatively high weight.

The contact surface of the winch apparatus configured for engaging the load-bearing spoolable medium and/or the plurality of load-bearing elements, may comprise a substantially flat surface.

The contact surface of the winch apparatus may comprise a substantially continuous surface, e.g. a drum surface. The contact surface of the winch apparatus may comprise an interrupted surface, e.g. may be defined by a plurality of support elements, e.g. plurality of circumferentially arranged support elements which may collectively define a/the contact surface.

The contact surface may comprise a grooved profile, e.g. may comprise at least one groove. In one embodiment the at least one groove may be arranged to receive and/or guide the load-bearing spoolable medium and/or the plurality of load-bearing elements on the contact surface.

The winch apparatus may comprise one or more sheaved wheels, a single drum winch, a multiple drum winch, or the like.

The load-bearing apparatus may comprise a tension control apparatus for controlling, applying and/or adjusting the tension of the load-bearing spoolable medium and/or the plurality of load-bearing elements, e.g. on an inboard or low tension side of the winch apparatus.

The tension control apparatus may be located on an inboard side of the winch apparatus.

The tension control apparatus may be arranged to individually and/or independently control, apply, and/or adjust the tension of each of the plurality of load-bearing elements.

The tension control apparatus may comprise at least one tension control device.

The tension control apparatus may comprise one tension control device capable of controlling, applying and/or adjusting the tension of each of the plurality of load-bearing elements.

The tension control apparatus may comprise a plurality of tension control devices, each capable of controlling, applying and/or adjusting the tension of a respective load-bearing element, e.g. individually and/or independently. By such provision, any variation in tension between load-bearing elements on an outboard side of the winch apparatus, e.g. due to marine currents, interfering objects, rope construction, etc, may be mitigated and/or overcome by controlling and/or adjusting the tension of each of the load-bearing elements on an inboard side of the winch apparatus. This is because the tension gradient on the winch apparatus may be defined by the capstan friction equation:

$$\frac{T_1}{T_2} = e^{\mu\theta}$$

wherein:

$T_1$=outboard tension $T_2$=inboard tension $\mu$=co-efficient of friction between the load-bearing element and the drum or contact surface $\theta$=angle of contact with the drum or contact surface (e.g., one wrap is $2\pi$ radians)

Therefore, assuming that $\mu$ and $\theta$ are known, $T_1$ on the outboard side can be controlled and/or maintained at a predetermined or desired value by controlling and/or maintaining $T_2$ on the inboard side at a predetermined value.

In one embodiment, the at least one tension control apparatus may be configured to maintain or apply substantially equal tensions between the load-bearing elements, e.g. when the load-bearing elements are of substantially equal dimension, e.g. diameter. The at least one tension control apparatus may be configured to maintain or apply substantially equal tensions between respective outboard portions of the plurality of load-bearing elements. By such provision, the weight of the at least one load may be substantially equally distributed amongst the load-bearing elements, thus preventing any of the ropes from experiencing overload that may lead to premature failure. This may also ensure compliance within a minimum safety standards in the industry. Offshore lifting operations are regulated by classification society rules and regulations, which include for example DNV, Bureau Veritas and Lloyds Register. All lifting and lowering operations have to maintain a certain minimum safety factor (SF) within the lifting system related to a payload, the SF including not only the weight in air but any added mass or other dynamic factors the payload will see during deployment. Typical minimum SF for offshore operations is in the order of 3.5× the payload. Thus, controlling the inboard tension of each load-bearing element to maintain substantially equal outboard tensions between the plurality of load-bearing elements, may assist in complying with minimum safety regulations in a particular industry, such as offshore lifting operations. Another advantage may include reducing the difference in load elongation between the load-bearing elements, which may lead to undesirable relative movement or slip between the load-bearing elements on the winch apparatus.

In another embodiment, the at least one tension control apparatus may be configured to maintain or apply different tensions between the load-bearing elements. The at least one tension control apparatus may be configured to maintain or apply different tensions between respective outboard portions and/or inboard portions of the plurality of load-bearing elements. This may help accommodate, for example, operational or environmental requirements, fatigue or wear of one or more load-bearing elements, etc.

Various combinations of the above may be envisaged. For example, the at least one tension control apparatus may be configured to maintain or apply substantially equal tensions between two or more of the load-bearing elements, and may be configured to maintain or apply different tensions between two or more of the load-bearing elements.

The tension control apparatus may be arranged to maintain a difference in tension between the load-bearing elements at a predetermined level, e.g. below a predetermined limit, such as below about 20%, e.g. below about 10%, e.g. below about 5%. The tension control apparatus may be arranged to maintain a difference in tension between the load-bearing elements at a particular or predetermined position relative to the winch apparatus, e.g. on an outboard side and/or on an inboard side thereof.

The tension control device(s) may comprise at least one drum, winch, sheave, track system, or the like.

The load-bearing apparatus, e.g. the tension control apparatus, may comprise a sensing device or arrangement.

The sensing device or arrangement may be arranged to sense or measure at least one property or parameter of at least one portion of the load-bearing apparatus. The sensing device or arrangement may be arranged to sense or measure at least one property or parameter of the load-bearing spoolable medium.

The sensing device or arrangement may comprise at least one tension-measuring device, e.g. meter, for measuring the tension of one or more load-bearing elements, e.g. of the plurality of load-bearing elements, e.g. on an inboard portion thereof.

In one embodiment, the sensing device or arrangement may comprise a plurality of tension-measuring devices, each capable of measuring the tension of a respective load-bearing element, e.g. on an inboard portion thereof.

The sensing device or arrangement may comprise a sensor associated with the winch apparatus, e.g. a rotational sensor.

The sensing device or arrangement may comprise a sensor for measuring the deviation or movement of the load-bearing elements on the winch apparatus, e.g. on a drum thereof.

The sensing device or arrangement may comprise a sensor for measuring the length of rope provided engaging the winch apparatus, e.g. a contact surface thereof. By such provision, any slip of one or more load-bearing elements on the winch apparatus, e.g. due to excessive tension, may be detected.

The load-bearing apparatus, e.g. the tension control apparatus, may comprise at least one actuator, e.g. a tension control actuator. The at least one actuator, e.g. tension control actuator, may be arranged for actuating the at least one tension control device, or may form part of the at least one tension control device.

The at least one actuator may comprise a motor.

In one embodiment, the load-bearing apparatus, e.g. the tension control apparatus, may comprise a plurality of actuators, each capable of actuating a respective tension control device.

The sensing device or arrangement may be arranged to provide feedback, e.g. to a user or operator, and/or may comprise a closed-loop control system, e.g. a closed-loop tension control apparatus.

The sensing device or arrangement may be provided with a display, e.g. a graphic, alphanumeric, audio, and/or tactile display, arranged to provide feedback, e.g. an indication of a measurement made by the sensing device or arrangement.

The at least one actuator may be activated manually, e.g. by a user, for example in response to a measurement made by the sensing device or arrangement, such as a change in tension measured by the at least one tension-measuring device.

The at least one actuator may be activated automatically and/or may form part of a closed-loop system, e.g. a closed-loop tension control apparatus. In one embodiment, the at least one actuator may be associated with the at least one tension-measuring device, such that departure in tension from a predetermined range may automatically activate the at least one actuator, and/or cause the at least one actuator to actuate the at least one tension control device.

The load-bearing apparatus may further comprise a storage apparatus for storing the load-bearing medium.

The storage apparatus may be provided on an inboard side of the winch apparatus, e.g. on an inboard side of the tension control apparatus.

The storage apparatus may comprise one or more storage devices.

In one embodiment, the storage apparatus may comprise one storage device capable of storing the load-bearing spoolable medium, e.g. the plurality of load-bearing elements.

In another embodiment, the storage apparatus may comprise a plurality of storage devices, each capable of storing a relative load-bearing element.

The storage apparatus may comprise one or more container, reel, or the like.

The load-bearing apparatus may be used in applications requiring supporting or moving, e.g. lowering or hoisting, of a load. Such applications may comprise subsea applications, such as on off-shore platforms or vessels; cranes such as off-shore on on-land cranes; towing systems; weight, counterweight, or cantilever devices; tension controlling devices; or the like.

According to a second aspect of the present invention there is provided a load-bearing apparatus comprising:

a winch apparatus; and a load-bearing spoolable medium for connecting to a load, the load-bearing medium comprising a plurality of load-bearing elements;

wherein at least a portion of the load-bearing spoolable medium is spooled about the winch apparatus;

wherein the load-bearing elements are arranged side-by-side on a contact surface of the winch apparatus.

At least a portion of the load-bearing spoolable medium may be spooled about a contact surface of the winch apparatus.

The load-bearing medium may comprises a plurality of adjacent load-bearing elements.

The load-bearing elements may be arranged side-by-side on the winch apparatus, e.g. on a contact surface of the winch apparatus.

The load-bearing elements may be arranged in a common plane.

The load-bearing elements may be arranged on the winch apparatus in a plane being generally in a direction of an axis, e.g. of a rotational axis, of the winch apparatus.

The load-bearing elements, e.g. the adjacent and/or side-by-side load-bearing elements, may be substantially parallel to each other, e.g. when in engagement with the contact surface of the winch apparatus. The load-bearing elements may be substantially parallel to each other when in engagement with the contact surface of the winch apparatus, in a plane substantially parallel to an axis, e.g. to an axis of rotation, of the winch apparatus.

The features described in respect of the load-bearing apparatus according to a first aspect of the present invention may apply in respect of the load-bearing apparatus according to a second aspect of the present invention, and are therefore not repeated here for brevity.

According to a third aspect of the present invention there is provided a winch apparatus comprising a contact surface configured for engaging a load-bearing spoolable medium comprising plurality of load-bearing elements arranged side-by-side on a contact surface of the winch apparatus.

The plurality of load-bearing elements may collectively define a load-bearing spoolable medium.

The plurality of load-bearing elements may be adapted to support, connect to and/or attach to a load.

The winch apparatus may be configured to control paying out and/or paying in of the plurality of load-bearing elements. The winch apparatus may be configured to control paying out and/or paying in of each of the plurality of load-bearing elements simultaneously.

The winch apparatus may be configured to function as a detensioning device for use in reducing tension within the load-bearing medium. As such the winch apparatus may comprise or define a detensioning device.

The winch apparatus may be configured as a capstan winch.

The winch apparatus may comprise an outboard or high tension side, between the load and the winch apparatus.

The winch apparatus may comprise an inboard or low tension side, on a side of the winch apparatus opposite the load.

The contact surface of the winch apparatus may be configured for engaging a plurality of adjacent load-bearing elements.

The contact surface of the winch apparatus may be configured for engaging a plurality of load-bearing elements which may be substantially parallel to each other, at least when in engagement with the contact surface of the winch apparatus. The load-bearing elements may be substantially parallel to each other when in engagement with the contact surface of the winch apparatus, in a plane substantially parallel to an axis of rotation of the winch apparatus. The load-bearing elements may be substantially parallel to each other on an outboard side of the winch apparatus.

The contact surface of the winch apparatus may comprise a substantially flat surface.

The contact surface of the winch apparatus may comprise a substantially continuous surface, e.g. a drum surface. The contact surface of the winch apparatus may comprise an interrupted surface, e.g. may be defined by a plurality of support elements, e.g. plurality of circumferentially arranged support elements which may collectively define a/the contact surface.

The contact surface may comprise a grooved profile, e.g. may comprise at least one groove. In one embodiment the at least one groove may be arranged to receive and/or guide the plurality of load-bearing elements on the contact surface.

The winch apparatus may comprise one or more sheaved wheels, a single drum winch, a multiple drum winch, or the like.

The features described in respect of the load-bearing apparatus according to a first aspect or a second aspect of the present invention may apply in respect of the winch apparatus according to a third aspect of the present invention, and are therefore not repeated here for brevity.

According to a fourth aspect of the present invention there is provided a plurality of load-bearing elements configured for connecting to a load at or near one end thereof, wherein the plurality of load-bearing elements is arranged side-by-side and is configured to engage a contact surface of a winch apparatus.

The plurality of load-bearing elements may comprise an outboard or high tension portion, between the load and the winch apparatus.

The plurality of load-bearing elements may comprise an inboard or low tension portion, on a side of the winch apparatus opposite the load.

One or more load-bearing elements may comprise an elongate element, such as a rope, cable, wire, or the like.

One or more load-bearing elements may comprise a multicomponent element, such as a rope, cable, wire, or the like.

One or more load-bearing elements may comprise a synthetic fibre rope, a metal rope such as a steel rope, or the like.

The cross-section of one or more load-bearing elements may be substantially circular, oval, rectangular (e.g. a so-called "flat rope), or may have any other suitable profile.

The plurality of load-bearing elements may comprises a plurality of separate and/or distinct load-bearing elements. It will be understood that the terms "separate and distinct" are not meant to limit the configuration of the load-bearing elements relative to each other, i.e. the load-bearing elements may be in contact, or may not be in contact, with each other. Thus, the terms "separate and distinct" are meant to indicate that the load-bearing elements each support, e.g. independently, a proportion, e.g. a predetermined amount or proportion of the weight of the load. By such provision, a dimension, e.g. a diameter, of each of the load-bearing elements may be reduced compared to a dimension, e.g. diameter, of a corresponding single load-bearing medium that would be required to support the same load. One of the effects and advantages of such reduction in diameter of the load-bearing elements is that the diameter of a winch used with such load-bearing elements may be reduced. Winch systems typically have an optimum diameter based on the diameter of the spoolable medium used. Therefore, reduction in the diameter of the load-bearing elements may allow significant reduction in the diameter of the winch apparatus, e.g. a drum thereof.

The plurality of load-bearing elements may comprise a plurality of adjacent load-bearing elements.

The load-bearing elements may be arranged side-by-side on the winch apparatus, e.g. on a contact surface of the winch apparatus.

The load-bearing elements may be arranged in a common plane.

The load-bearing elements may be arranged on the winch apparatus in a plane being generally in a direction of an axis, e.g. to a rotational axis, of the winch apparatus.

The load-bearing elements, e.g. the adjacent and/or side-by-side load-bearing elements, may be substantially parallel to each other, e.g. when in engagement with the contact surface of the winch apparatus. The load-bearing elements may be substantially parallel to each other when in engagement with the contact surface of the winch apparatus, in a plane substantially parallel to an axis, e.g. to an axis of rotation, of the winch apparatus.

The load-bearing elements, e.g. an outboard portion thereof, may be substantially parallel to each other.

The features described in respect of the load-bearing apparatus according to a first aspect or a second aspect of the present invention may apply in respect of the plurality of load-bearing elements according to a fourth aspect of the present invention, and are therefore not repeated here for brevity.

According to a fifth aspect of the present invention there is provided a tension control apparatus for controlling, applying and/or adjusting the tension of a plurality of load-bearing elements engaging a contact surface of a winch apparatus, wherein the tension control apparatus is provided on an inboard or low tension side of the winch apparatus.

The tension control apparatus may be arranged to individually and/or independently control, apply, and/or adjust the tension of each of the plurality of load-bearing elements.

The tension control apparatus may comprise at least one tension control device.

The tension control apparatus may comprise one tension control device capable of controlling, applying and/or adjusting the tension of each of the plurality of load-bearing elements.

The tension control apparatus may comprise a plurality of tension control devices, each capable of controlling, applying and/or adjusting the tension of a respective load-bearing element. By such provision, any variation in tension between load-bearing elements on an outboard side of the winch apparatus, e.g. due to marine currents, interfering objects, rope construction, etc, may be mitigated and/or overcome by controlling and/or adjusting the tension of each of the load-bearing elements on an inboard side of the winch apparatus. This is because the tension gradient on the winch apparatus may be defined by the capstan friction equation:

$$\frac{T_1}{T_2} = e^{\mu\theta}$$

wherein:

$T_1$=outboard tension $T_2$=inboard tension $\mu$=co-efficient of friction between the load-bearing element and the drum or contact surface $\theta$=angle of contact with the drum or contact surface (e.g., one wrap is $2\pi$ radians)

Therefore, assuming that $\mu$ and $\theta$ are known, $T_1$ on the outboard side can be controlled and/or maintained at a predetermined or desired value by controlling and/or maintaining $T_2$ on the inboard side at a predetermined value.

In one embodiment, the at least one tension control apparatus may be configured to maintain or apply substantially equal tensions between the load-bearing elements, e.g. when the load-bearing elements are of substantially equal dimension, e.g. diameter. The at least one tension control apparatus may be configured to maintain or apply substantially equal tensions between respective outboard portions of the plurality of load-bearing elements. By such provision, the weight of the at least one load may be substantially equally distributed amongst the load-bearing elements, thus preventing any of the ropes from experiencing overload that may lead to premature failure. This may also ensure compliance within a minimum safety standards in the industry. Offshore lifting operations are regulated by classification society rules and regulations, which include for example DNV, Bureau Veritas and Lloyds Register. All lifting and lowering operations have to maintain a certain minimum safety factor (SF) within the lifting system related to a payload, the SF including not only the weight in air but any added mass or other dynamic factors the payload will see during deployment. Typical minimum SF for offshore operations is in the order of 3.5× the payload. Thus, controlling the inboard tension of each load-bearing element to maintain substantially equal outboard tensions between the plurality of load-bearing elements, may assist in complying with minimum safety regulations in a particular industry, such as offshore lifting operations. Another advantage may include reducing the difference in load elongation between the load-bearing elements, which may lead to undesirable relative movement or slip between the load-bearing elements on the winch apparatus.

In another embodiment, the at least one tension control apparatus may be configured to maintain or apply different tensions between the load-bearing elements. The at least one tension control apparatus may be configured to maintain or apply different tensions between respective outboard portions of the plurality of load-bearing elements. This may help accommodate, for example, operational or environmental requirements, fatigue or wear of one or more load-bearing elements, etc.

Various combinations of the above may be envisaged. For example, the at least one tension control apparatus may be configured to maintain or apply substantially equal tensions between two or more of the load-bearing elements, and may be configured to maintain or apply different tensions between two or more of the load-bearing elements.

The tension control apparatus may be arranged to maintain a difference in tension between the load-bearing elements at a predetermined level, e.g. below a predetermined limit, such as below about 20%, e.g. below about 10%, e.g. below about 5%. The tension control apparatus may be arranged to maintain a difference in tension between the load-bearing elements at a particular position relative to the winch apparatus, e.g. on an outboard side and/or on an inboard side thereof.

The tension control device(s) may comprise at least one drum, winch, sheave, track system, or the like.

The load-bearing apparatus, e.g. the tension control apparatus, may comprise a sensing device or arrangement.

The sensing device or arrangement may be arranged to sense or measure at least one property or parameter of at least one portion of the load-bearing apparatus. The sensing device or arrangement may be arranged to sense or measure at least one property or parameter of the load-bearing spoolable medium.

The sensing device or arrangement may comprise at least one tension-measuring device, e.g. meter, for measuring the tension of the plurality of load-bearing elements, e.g. on an inboard portion thereof.

In one embodiment, the sensing device or arrangement may comprise a plurality of tension-measuring devices, each capable of measuring the tension of a respective load-bearing element, e.g. on an inboard portion thereof.

The sensing device or arrangement may comprise a sensor associated with the winch apparatus, e.g. a rotational sensor.

The sensing device or arrangement may comprise a sensor for measuring the deviation or movement of the load-bearing elements on the winch apparatus, e.g. on a drum thereof.

The sensing device or arrangement may comprise a sensor for measuring the length of rope provided engaging the winch apparatus, e.g. a contact surface thereof. By such provision, and slip of one or more load-bearing elements on the winch apparatus, e.g. due to excessive tension, may be detected.

The load-bearing apparatus, e.g. the tension control apparatus, may comprise at least one actuator, e.g. a tension control actuator. The at least one actuator, e.g. tension control actuator, may be arranged for actuating the at least one tension control device, or may form part of the at least one tension control device.

The at least one actuator may comprise a motor.

In one embodiment, the load-bearing apparatus, e.g. the tension control apparatus, may comprise a plurality of actuators, each capable of actuating a respective tension control device.

The sensing device or arrangement may be arranged to provide feedback to a user, and/or may comprise a closed-loop control system, e.g. a closed-loop tension control apparatus.

The sensing device or arrangement may be provided with a display, e.g. a graphic, alphanumeric, audio, and/or tactile display, arranged to provide feedback, e.g. an indication of a measurement made by the sensing device or arrangement.

The at least one actuator may be activated manually, e.g. by a user, for example in response to a measurement made by the sensing device or arrangement, such as a change in tension measured by the at least one tension-measuring device.

The at least one actuator may be activated automatically and/or may form part of a closed-loop system, e.g. a closed-loop tension control apparatus. In one embodiment, the at least one actuator may be associated with the at least one tension-measuring device, such that departure in tension from a predetermined range may automatically activate the at least one actuator, and/or cause the at least one actuator to actuate the at least one tension control device.

The features described in respect of the load-bearing apparatus according to a first aspect or second of the present invention may apply in respect of the tension control apparatus according to a fifth aspect of the present invention, and are therefore not repeated here for brevity.

According to a sixth aspect of the present invention there is provided a load-bearing apparatus comprising:

a winch apparatus; and a load-bearing spoolable medium for connecting to a load on an outboard side of the winch apparatus, the load-bearing medium comprising a plurality of load-bearing elements, wherein at least a portion of the load-bearing spoolable medium is spooled about the winch apparatus, and wherein the load-bearing elements are arranged side-by-side on a contact surface of the winch apparatus; and a tension control apparatus for controlling, applying and/or adjusting the tension of the plurality of load-bearing elements on an inboard side of the winch apparatus.

The features described in respect of any of the first to fifth aspects of the present invention may apply in respect of the load-bearing apparatus according to a sixth aspect of the present invention, and are therefore not repeated here for brevity.

According to a seventh aspect of the present invention there is provided a method for bearing a load, comprising:

connecting and/or attaching a load to a load-bearing spoolable medium, wherein the load-bearing medium comprises a plurality of load-bearing elements; and engaging the plurality of load-bearing elements with a contact surface of a winch apparatus.

The method may comprise engaging the plurality of load-bearing elements side-by-side with the contact surface.

The method may comprise controlling paying out and/or paying in of the plurality of load-bearing elements. The method may comprise controlling paying out and/or paying in of the plurality of load-bearing elements simultaneously by actuating the winch apparatus.

The method may comprise controlling applying and/or adjusting the tension of the plurality of load-bearing elements on an inboard side of the winch apparatus.

The method may comprise controlling applying and/or adjusting the tension of an inboard portion of the load-bearing elements.

The method may comprise controlling, applying, and/or adjusting the tension of each of the plurality of load-bearing elements individually and/or independently.

The method may comprise sensing and/or measuring at least one property or parameter of at least one portion of one or more load-bearing element and/or of the winch apparatus.

The method may comprise measuring the tension of the plurality of load-bearing elements, e.g. on an inboard portion thereof.

The method may comprise measuring the tension of each load-bearing element, e.g. on an inboard portion thereof.

The method may comprise controlling, applying and/or adjusting the tension of one or more load-bearing element in response to measuring the tension of one or more load-bearing element, e.g. on an inboard portion thereof.

The method may comprise operating in a closed-loop control system. The method may comprise automatically controlling, applying and/or adjusting the tension of one or more load-bearing element in response to measuring the tension of one or more load-bearing element, e.g. on an inboard portion thereof.

The method may comprise providing feedback, e.g. to a user or operator, following measurement of the tension of one or more load-bearing element.

The method may comprise manually controlling, applying and/or adjusting the tension of one or more load-bearing element in response to measuring the tension of one or more load-bearing element, e.g. on an inboard portion thereof.

The features described in respect of the load-bearing apparatus according to a first, second or sixth aspect of the present invention, the winch apparatus according to a third aspect of the present invention, the plurality of load-bearing elements according to a fourth aspect of the present invention, or the tension control apparatus according to a fifth aspect of the present invention may apply in respect of the method according to a seventh aspect of the present invention, and are therefore not repeated here for brevity.

BRIEF DESCRIPTION OF DRAWINGS

Embodiments of the present invention will now be described by way of example only, with reference to the accompanying drawings, in which.

DETAILED DESCRIPTION OF DRAWINGS

Figure 1:
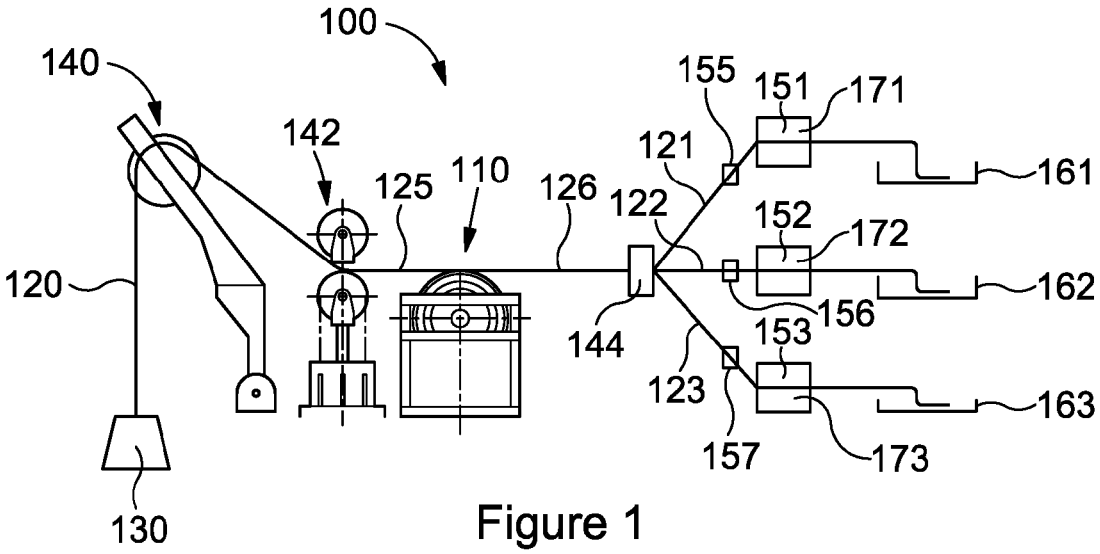
FIG. 1 is a schematic side view representation of a load-bearing apparatus according to a first embodiment of the present invention.

FIG. 1 shows a schematic side view representation of a load-bearing apparatus 100 according to a first embodiment of the present invention.

The exemplary load-bearing apparatus 100 of FIG. 1 reflects an offshore application such as an off-shore platform or vessel. However, the load-bearing apparatus 100 may equally find use in other applications, for example cranes such as off-shore on on-land cranes; towing systems; weight, counterweight, or cantilever devices; tension controlling devices; structural applications such as station keeping or any other structural applications requiring dynamic positioning and/or tensioning of a structure; or the like.

The load-bearing apparatus 100 comprises a winch apparatus 110.

The load-bearing apparatus 100 also comprises a load-bearing spoolable medium 120 for connecting to a load 130.

Figure 2:
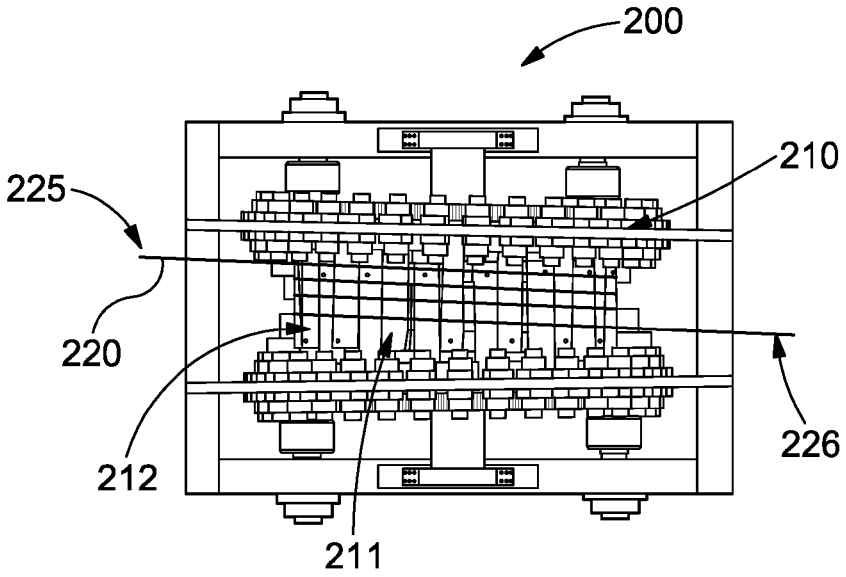
FIG. 2 is a top view of a load-bearing apparatus according to a second embodiment of the present invention.

The load-bearing spoolable medium 120 is shown in schematic form in FIGS. 1 and 2 for ease of reading. The load-bearing spoolable medium 120 comprises a plurality of load-bearing elements 121,122,123, best shown in FIGS. 3 and 4.

In this embodiment, the plurality of load-bearing elements comprises three load-bearing elements 121,122,123.

A portion of the load-bearing spoolable medium 120 is spooled about the winch apparatus 110.

The winch apparatus 110 is configured to control paying out and/or paying in of the load-bearing spoolable medium 120. The winch apparatus 110 is configured to function as a detensioning device to reduce tension within the load-bearing spoolable medium 120.

The load-bearing spoolable medium 120 defines an outboard or high tension portion 125, between the load 130 and the winch apparatus 110, and defines an inboard or low tension portion 126, on a side of the winch apparatus 110 opposite the load 130.

The load-bearing spoolable medium 120 and the winch apparatus 110 are described in more detail with reference to FIGS. 2, 3 and 4.

The load-bearing apparatus 100 includes an overboarding assembly 140 which is used to appropriately direct a spoolable medium 120 from a vessel (not shown) into the sea. Additionally, a heave compensator 142 is provided which provides dynamic compensation to the spoolable medium 120 to accommodate for heaving motion of the associated vessel.

The load-bearing apparatus 100 comprises a guide 144 for guiding each of the load-bearing elements 121,122,123 towards a respective tension control apparatus 151,152,153. The tension control apparatuses 151,152,153 are provided to control, apply and/or adjust the tension of a respective load-bearing element 121,122,123, on an inboard portion 126 thereof.

The tension control apparatus 151,152,153 is further described in more detail with reference to FIGS. 5 and 6.

The load-bearing apparatus 100 further includes a storage apparatus 161,162,163, which in this embodiment is provided in the form of a plurality of storage baskets 161,162, 163, which permit a respective load-bearing element 121, 122,123 to be stored in a zero or near zero tension state.

FIG. 2 shows a load-bearing apparatus 200 according to a second embodiment of the present invention, showing load-bearing spoolable medium 220 and winch apparatus 210. The load-bearing spoolable medium 220 and winch apparatus 210 are generally similar to the load-bearing spoolable medium 120 and winch apparatus 110 of FIG. 1, like part denoted by like numerals, incremented by '100'.

The winch apparatus 210 has a contact surface 211 configured for engaging the load-bearing spoolable medium 220. Although not shown in the schematic representation of FIG. 2 for ease of representation, load-bearing spoolable medium 220 comprises a plurality of load-bearing elements arranged side-by-side on contact surface 211 of the winch apparatus 210.

In the embodiment of FIG. 2, the contact surface 211 of the winch apparatus 210 comprises a plurality of circumferentially arranged support elements 212 or slats each having discrete contact surfaces which collectively define a drum contact surface.

Figure 3:
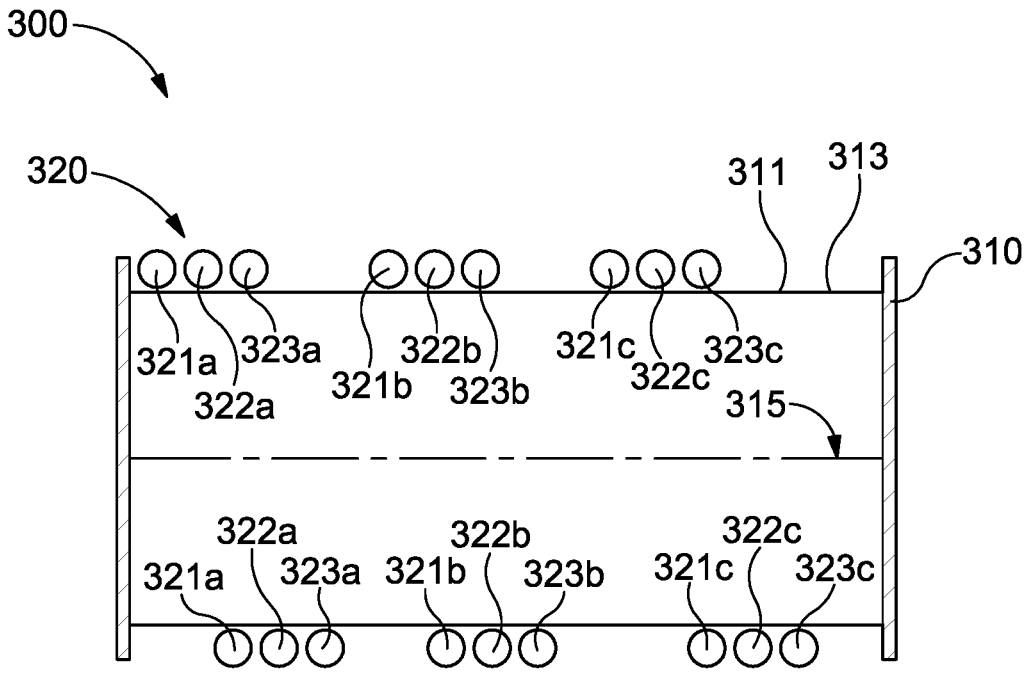
FIG. 3 is a cross-sectional view of a load-bearing apparatus according to a third embodiment of the present invention.

FIG. 3 shows a load-bearing apparatus 300 according to a third embodiment of the present invention, showing load-bearing spoolable medium 320 and winch apparatus 310. The load-bearing spoolable medium 320 and winch apparatus 310 are generally similar to the load-bearing spoolable medium 120 and winch apparatus 110 of FIG. 1, like part denoted by like numerals, incremented by '200'.

In the embodiment of FIG. 3, the contact surface 311 of the winch apparatus 310 comprises a substantially continuous, flat, surface 313.

Figure 4:
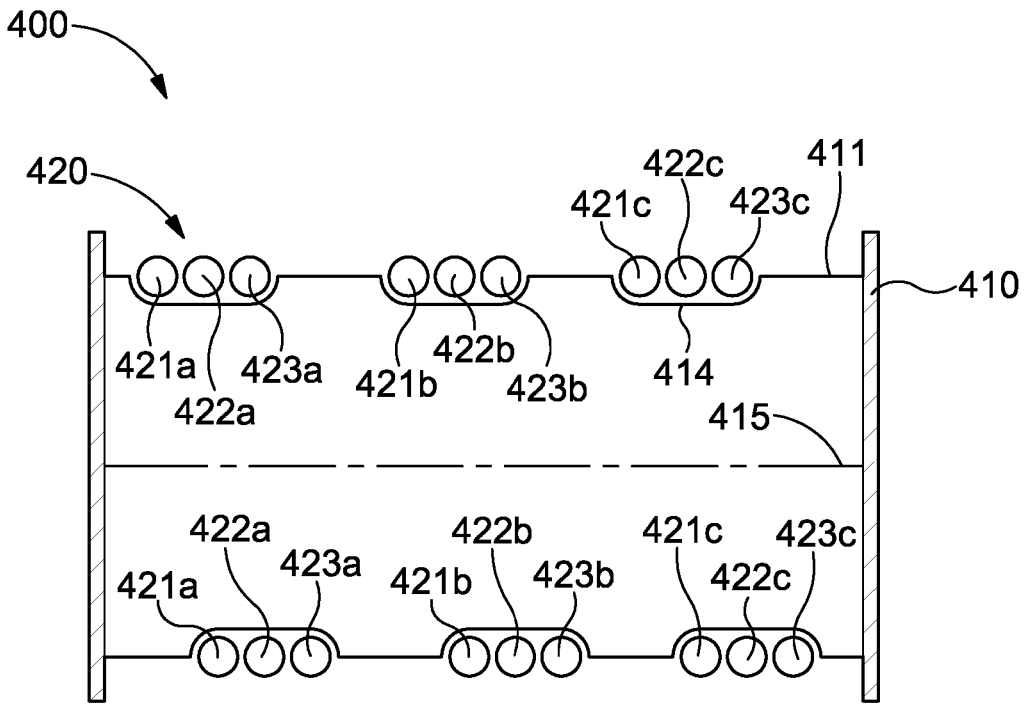
FIG. 4 is a cross-sectional view of a load-bearing apparatus according to a fourth embodiment of the present invention.

FIG. 4 shows a load-bearing apparatus 400 according to a fourth embodiment of the present invention, showing load-bearing spoolable medium 420 and winch apparatus 410. The load-bearing spoolable medium 420 and winch apparatus 410 are generally similar to the load-bearing spoolable medium 420 and winch apparatus 410 of FIG. 1, like part denoted by like numerals, incremented by '300'.

In the embodiment of FIG. 4, the contact surface 411 of the winch apparatus 410 comprises a grooved surface having groove 414. The groove 414 is arranged to receive and guide the plurality of load-bearing elements 421,422,423 on the contact surface 411 as the load-bearing elements 421,422, 423 are wound about the winch apparatus 410.

In the embodiments of FIGS. 3 and 4, the load-bearing spoolable medium 320,420 comprises three separate, distinct load-bearing elements 321,322,323 and 421,422,423 arranged side-by-side. Provision of a plurality of load-bearing elements 121,122,123, 321,322,323 and 421,422, 423 arranged side-by-side permits reduction of a diameter of each of the load-bearing elements 121,122,123, 321,322,323 and 421,422,423 compared to a diameter of a corresponding single load-bearing medium that would be required to support the same load 130. One of the effects and advantages of such reduction in diameter of the load-bearing elements 121,122,123, 321,322,323 and 421,422,423 is that the diameter of the winch apparatus 110,310,410 used with such load-bearing elements 121,122,123, 321,322,323 and 421, 422,423 may be reduced, therefore reducing costs, ease of handling, and safety.

In this embodiment, each load-bearing element 321,322, 323 and 421,422,423 comprises a synthetic fibre rope. The provision of three load-bearing elements significantly reduces the diameter appropriate for the winch apparatus 310,410, while maintaining the number of load-bearing elements relatively low to minimise difficulty of handling or risks of malfunction associated with a multiple rope system.

For a load of 250Te, a standard 136 mm diameter single rope having a minimum break load (MBL) of 1125Te would give a safety factor of 4.5.

For the same load capacity, each of the three load-bearing elements 321,322,323 and 421,422,423 of FIGS. 3 and 4 may have a diameter in the region of 70-90 mm, e.g. approximately 78 mm. This reduced diameter in each of the load-bearing elements allows reduction in the diameter of the associated winch apparatus 310,410.

In other embodiments using two load-bearing elements (not shown), each of the two load-bearing elements may have a diameter in the region of 80-100 mm, e.g. approximately 88 mm. This reduced diameter in each of the load-bearing elements allows reduction in the diameter of the associated winch apparatus 310,410.

In other embodiments using four load-bearing elements (not shown), each of the four load-bearing elements may have a diameter in the region of 50-80 mm, e.g. approximately 66 mm. This reduced diameter in each of the load-bearing elements allows reduction in the diameter of the associated winch apparatus 310,410.

FIGS. 3 and 4 depict load-bearing elements 321,322,323 and 421,422,423 having a substantially circular cross-section. However, this is for ease of representation only, and other rope profiles may be equally suitable for use in the present invention, such as flat ropes, or the likes.

The load-bearing elements 321,322,323 and 421,422,423 are substantially parallel to each other on the contact surface 311,411 of the winch apparatus 310,410, in a plane substantially parallel to an axis of rotation 315,415 of the winch apparatus 310,410, and tangential to the contact surface 311,411.

In this embodiment, the load-bearing spoolable medium 320,420 defines three turns around the winch apparatus 310,410. It will be understood that the load-bearing spoolable medium 320,420 may define fewer, or more, turns, but only three turns are shown in FIGS. 3 and 4 for ease of understanding.

The load-bearing elements 321,322,323 and 421,422,423 are provided in sequential order around the contact surface 311,411 of the winch apparatus 310,410. That is, each of the first, second and third turns (represented respectively by suffix a,b,c) defines in sequential order first, second and third load-bearing elements 321,322,323 and 421,422,423. A turn of a load-bearing element may be separated from an adjacent turn of the same load-bearing element, by the remaining load-bearing elements. As see on FIGS. 3 and 4, first load-bearing element 321*a*,421*a* of the first turn is separated from first load-bearing element 321*b*,421*b* of the second turn by second and third load-bearing elements 322*a*,323*a*, 422*a*,423*a* of the first turn. Similarly, first load-bearing element 321*b*,421*b* of the second turn is separated from first load-bearing element 321*c*,421*c* of the third turn by second and third load-bearing elements 322*b*,323*b*,422*b*,423*b* of the second turn.

In this embodiment, the diameter of each of the plurality of load-bearing elements 321,322,323 and 421,422,423 is identical.

Figure 5:
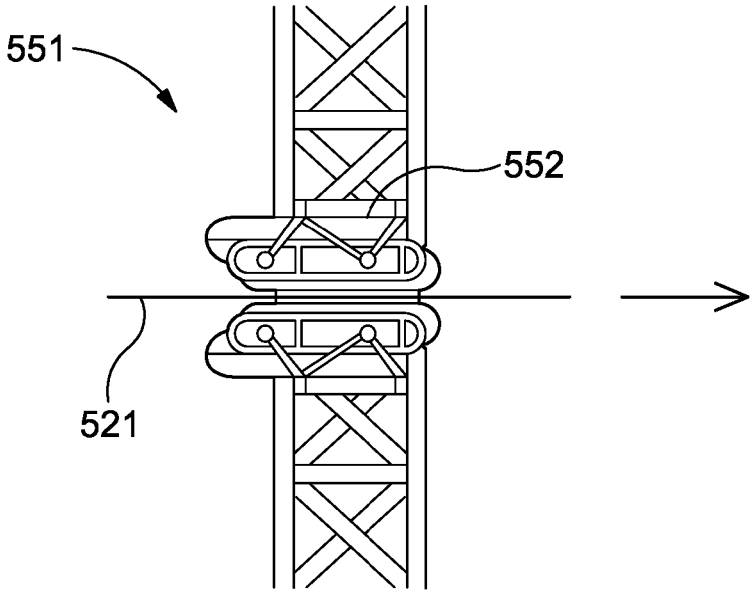
FIG. 5 is a side view of a tension control apparatus according to a fifth embodiment of the present invention.

FIG. 5 is a side view of a tension control apparatus 551 according to a fifth embodiment of the present invention. The tension control apparatus 551 is generally similar to the tension control apparatus 151,152,153 of FIG. 1, like part denoted by like numerals, incremented by '400'.

In the embodiment of FIG. 5, the tension control apparatus 551 comprises a tension control device 552 for engaging load-bearing element 521. The tension control device 552 is in the form of a track tensioner.

Figure 6:
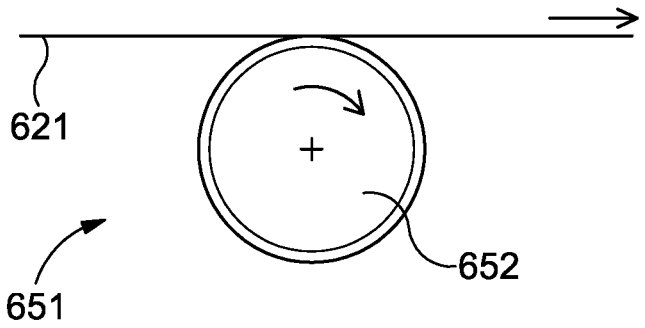
FIG. 6 is a side view of a tension control apparatus according to a sixth embodiment of the present invention.

FIG. 6 is a side view of a tension control apparatus 651 according to a sixth embodiment of the present invention. The tension control apparatus 651 is generally similar to the tension control apparatus 151,152,153 of FIG. 1, like part denoted by like numerals, incremented by '500'.

In the embodiment of FIG. 6, the tension control apparatus 651 comprises a tension control device 652 for engaging load-bearing element 621. The tension control device 652 is in the form of a drum, winch or sheave.

Referring back to FIG. 1, each tension control apparatus 151,152,153 is provided to control, apply and/or adjust the tension of a respective load-bearing element 121,122,123, on an inboard portion 126 thereof.

In this embodiment, the tension control apparatus 151, 152,153 are arranged to maintain a difference in tension between the load-bearing elements 121,122,123 at a predetermined level, e.g. below an upper limit such as below about 20%, e.g. below about 10%, e.g. below about 5%. In other embodiments, In another embodiment, the tension control apparatus 151,152,153 are configured to maintain or apply different tensions between the load-bearing elements. This may help accommodate, for example, operational or environmental requirements, fatigue or wear of one or more load-bearing elements, etc.

In this embodiment, each tension control apparatus 151, 152,153 comprises a respective sensing device 155,156,157 which is arranged to measure the tension of a respective load-bearing element 121,122,123 on an inboard portion 126 thereof.

In this embodiment, each tension control apparatus 151, 152,153 comprises a respective actuator 171,172,173, which in this embodiment forms part of a respective tension control device 151,152,153, and comprises a motor.

By such provision, the tension of each load-bearing element 121,122,123 may be individually and independently controlled, which may allow the apparatus 100 and/or a user to apply a desired tension on a outboard portion 125 of each load-bearing element 121,122,123.

It should be understood that the embodiments described herein are merely exemplary and that various modifications may be made thereto without departing from the scope of the present invention.

The invention claimed is:

1. A load-bearing apparatus comprising:

a detensioning winch apparatus defining an outboard side and an inboard side; and a load-bearing spoolable medium for connecting to a load on the outboard side of the detensioning winch apparatus, the load-bearing spoolable medium comprising a plurality of load-bearing elements, being spooled for at least one turn about the detensioning winch apparatus, and defining an outboard portion extending on the outboard side of the detensioning winch apparatus and an inboard portion extending on the inboard side of the detensioning winch apparatus; and a tension control apparatus for individually and variably controlling the tension of each of the plurality of load-bearing elements;

wherein the load-bearing elements are arranged side-by-side on a contact surface of the detensioning winch apparatus; and wherein the detensioning winch apparatus reduces tension within the load-bearing spoolable medium from the outboard portion to the inboard portion.

2. The load-bearing apparatus according to claim 1, wherein the plurality of load-bearing elements comprises 2 to 5 load-bearing elements.

3. The load-bearing apparatus according to claim 2, wherein the plurality of load-bearing elements comprises 3 load-bearing elements.

4. The load-bearing apparatus according to claim 1, further comprising a plurality of tension-measuring devices, each capable of measuring the tension of a respective load-bearing element.

5. The load-bearing apparatus according to claim 4, wherein at least one actuator and/or tension control device is activated and/or actuated in response to a measurement made by a/the tension-measuring device(s).

6. The load-bearing apparatus according to claim 1, wherein the tension control apparatus is provided on an inboard side of the detensioning winch apparatus, and is arranged to control, apply, and/or adjust the tension of an inboard portion of the plurality of load-bearing elements.

7. The load-bearing apparatus according to claim 6, wherein the tension control apparatus is arranged to control, apply, and/or adjust the tension of the inboard portion of the plurality of load-bearing elements to maintain or apply substantially equal tensions between respective outboard portions of the plurality of load-bearing elements.

8. The load-bearing apparatus according to claim 1, wherein the contact surface of the detensioning winch apparatus engages at least a portion of each of the plurality of load-bearing elements.

9. The load-bearing apparatus according to claim 1, wherein the detensioning winch apparatus comprises or defines a detensioning device.

10. The load-bearing apparatus according to claim 1, wherein one or more load-bearing elements comprise an elongate load-bearing element.

11. The load-bearing apparatus according to claim 1, wherein one or more load-bearing elements comprise a synthetic fibre rope.

12. The load-bearing apparatus according to claim 1, wherein the plurality of load-bearing elements comprises a plurality of separate load-bearing elements.

13. The load-bearing apparatus according to claim 1, wherein the load-bearing elements are arranged on the contact surface of the detensioning winch apparatus in a plane substantially parallel to an axis of rotation of the detensioning winch apparatus, and/or substantially tangential to the contact surface of the detensioning winch apparatus.

14. The load-bearing apparatus according to claim 1, wherein the load-bearing elements are arranged in sequential order around or about the detensioning winch apparatus.

15. The load-bearing apparatus according to claim 1, wherein a weight of the load is distributed amongst the plurality of load-bearing elements.

16. The load-bearing apparatus according to claim 1, wherein a diameter of each of the plurality of load-bearing elements is substantially identical.

17. The load-bearing apparatus according to claim 1, wherein a contact surface of the detensioning winch apparatus is substantially flat or grooved.

18. The load-bearing apparatus according to claim 1, wherein a contact surface of the detensioning winch apparatus is substantially continuous or interrupted.

19. The load-bearing apparatus according to claim 1, wherein the tension control apparatus comprises a plurality of tension control devices, each capable of controlling, applying and/or adjusting the tension of a respective load-bearing element.

20. The load-bearing apparatus according to claim 1, wherein the tension control apparatus is arranged to maintain a difference in tension between the load-bearing elements at or below a predetermined level.

21. The load-bearing apparatus according to claim 1, comprising a storage apparatus for storing the load-bearing spoolable medium on the inboard side of the detensioning winch apparatus.

22. A method for bearing a load, comprising:

spooling a load-bearing spoolable medium around a detensioning winch apparatus for at least one turn, wherein the load-bearing spoolable medium comprises a plurality of load-bearing elements arranged side-by-side on a contact surface of the detensioning winch apparatus, wherein the load-bearing spoolable medium defines an outboard portion extending on an outboard side of the detensioning winch apparatus and an inboard portion on an inboard side of the detensioning winch apparatus; and connecting a load to the load-bearing spoolable medium on the outboard side of the detensioning winch apparatus; and individually and variably controlling the tension of each of the plurality of load-bearing elements;

wherein the detensioning winch apparatus reduces tension within the load-bearing spoolable medium from the outboard portion to the inboard portion.

23. The method according to claim 22, comprising controlling paying out and/or paying in of the plurality of load-bearing elements.

24. The method according to claim 22, comprising controlling applying and/or adjusting the tension of the plurality of load-bearing elements on the inboard side of the detensioning winch apparatus and/or on the inboard portion of the load-bearing elements.

25. The method according to claim 22, comprising measuring the tension of each load-bearing element.

26. The method according to claim 22, comprising controlling, applying and/or adjusting the tension of one or more load-bearing elements in response to measuring the tension of one or more load-bearing element.

27. The method according to claim 22, comprising providing feedback following measurement of the tension of one or more load-bearing element.

28. The method according to claim 22, comprising operating in a closed-loop control system.

29. The method according to claim 22, comprising automatically controlling, applying and/or adjusting the tension of one or more load-bearing element in response to measuring the tension of one or more load-bearing element.

30. The method according to claim 22, comprising manually controlling, applying and/or adjusting the tension of one or more load-bearing element in response to measuring the tension of one or more load-bearing element.

31. A load-bearing apparatus comprising:

a winch apparatus; and a load-bearing spoolable medium for connecting to a load, the load-bearing spoolable medium comprising a plurality of load-bearing elements;

a tension control apparatus for controlling the tension of each of the plurality of load-bearing elements, the tension control apparatus comprising a plurality of tension control devices, each capable of controlling the tension of a respective load-bearing element and at least one actuator for actuating one or more tension control devices;

wherein at least a portion of the load-bearing spoolable medium is spooled about the winch apparatus, wherein the load-bearing elements are arranged side-by-side on a contact surface of the winch apparatus.

* * * * *